US007322221B2

(12) United States Patent
Löhr et al.

(10) Patent No.: US 7,322,221 B2
(45) Date of Patent: Jan. 29, 2008

(54) DEVICE FOR APPLYING LUBRICANTS ON THE PERIPHERAL SURFACES OF ROLLERS IN ROLL STANDS

(75) Inventors: Andreas Löhr, Herdorf (DE); Matthias Kipping, Herdorf (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 281 days.

(21) Appl. No.: 10/487,520

(22) PCT Filed: Aug. 23, 2002

(86) PCT No.: PCT/EP02/09437

§ 371 (c)(1),
(2), (4) Date: Feb. 19, 2004

(87) PCT Pub. No.: WO03/020451

PCT Pub. Date: Mar. 13, 2003

(65) Prior Publication Data

US 2004/0250756 A1 Dec. 16, 2004

(30) Foreign Application Priority Data

Sep. 4, 2001 (DE) ..... 101 43 252

(51) Int. Cl.
*B21B 27/06* (2006.01)
*B21B 13/14* (2006.01)

(52) U.S. Cl. ..... 72/236; 72/44; 118/262

(58) Field of Classification Search ..... 72/8.5, 72/38, 39, 41–45, 200, 201, 236, 364, 365.2; 118/244, 256, 258, 262

See application file for complete search history.

(56) References Cited

U.S. PATENT DOCUMENTS

| | | | | |
|---|---|---|---|---|
| 1,634,258 | A | 7/1927 | Halpin | |
| 3,803,888 | A * | 4/1974 | Hostetter et al. | 72/45 |
| 4,272,976 | A | 6/1981 | Pizzedaz | |
| 4,653,303 | A * | 3/1987 | Richard | 72/236 |
| 5,048,453 | A * | 9/1991 | Eriksson | 118/249 |
| 5,523,123 | A * | 6/1996 | Ginzburg et al. | 427/295 |
| 5,694,799 | A * | 12/1997 | Wolpert et al. | 72/43 |
| 7,209,699 | B2 * | 4/2007 | Yamaguchi et al. | 399/346 |

FOREIGN PATENT DOCUMENTS

| | | |
|---|---|---|
| JP | 57137010 | 8/1982 |
| JP | 60227906 | 11/1985 |
| JP | 06226323 | 8/1994 |
| SU | 532417 | 10/1976 |

* cited by examiner

*Primary Examiner*—Ed Tolan
(74) *Attorney, Agent, or Firm*—Andrew Wilford

(57) ABSTRACT

The invention relates to a device for applying lubricants on the peripheral surfaces of rollers in roll stands for rolling strips, more particularly multiple roll stands with support rollers and working rollers (SW; AW), wherein the lubricants are applied in an area of the peripheral surfaces of the working cylinder (AW) which impinges upon the rolling strip (WB) located between the upper or bottom strip surface and the strippers (AS) placed against the peripheral surfaces. The improvement to said device is characterized in that the lubricant is applied by means of the application rollers (ATW) that can be pressed against the peripheral surfaces of the working roller (AW), whose periphery is impinged upon by the periphery of a coaxially mounted transmission roller (UW) on the peripheral surface of which lubricant is applied by means of spraying, splashing or dipping devices (SD; TW).

14 Claims, 4 Drawing Sheets

DEVICE FOR APPLYING LUBRICANTS ON THE PERIPHERAL SURFACES OF ROLLERS IN ROLL STANDS

CROSS REFERENCE TO RELATED APPLICATIONS

This application is a national stage of PCT/EP02/09437 filed 23 Aug. 2002 and based upon German national application 101 43 252.6 of 4 Sep. 2001 under the International Convention.

FIELD OF THE INVENTION

The invention relates to a device for applying lubricant to the peripheral surfaces of the rolls in rolling mill stands for the rolling of strip, especially multiroll stands with backup and working rolls, with which the lubricant is applied to the peripheral surfaces of the working rolls engaging the strip to be rolled and this lubricant application is effected by means of applicator rollers pressed against the peripheral surfaces of the working rolls or continuously moving endless belts upon the peripheral surfaces of which the lubricant as applied by immersion rollers of spray, scattering or intermediate roll devices.

BACKGROUND OF THE INVENTION

Devices of this kind are known in numerous configurations. Thus U.S. Pat. No. 1,634,258 shows a-duo-horizontal rolling mill stand in which the two rolls each have an applicator roller pressed against their outer surfaces and comprised of an elastic material, the surfaces of the applicator rollers being treated with lubricant from a number of spray nozzles whereby the lubricant is then transferred from the surfaces of these applicator rollers to the surfaces of the horizontal rolls. The Japanese patent document 60 227 906 discloses a carrier which is shiftable radially against the surface of a working roll for an oil transfer roller and U.S. Pat. No. 4,272,976 discloses ahead and behind the working roll of a four-high rolling mill stand, spray nozzles which spread lubricant onto the working roll by pressing rolls and cooling air blowers which treat the rolls with cooling air. From Japanese patent document 57 137 010, a proposal has been made known whereby the lubricant is applied to the peripheral surfaces of the working rolls of a four-roll rolling mill stand in that between the working roll and a roller which is immersed in an open lubricating vessel, a transfer roller is arranged which picks up the lubricant from the surface of this immersion roller and applies it to the surface of the working roll. Finally from the Soviet patent publication 532417 the concept has been disclosed of an endless belt passing over guide rollers through a lubricant vessel and then contacting the working rolls of a rolling mill with the lubricant wetted side of the belt.

With these devices, the entire width of the peripheral surface of the working roll is always coated with lubricant and special care must be taken to keep the regions in which the lubricant has been applied to the working rolls above and below the rolled strip free from wayward water arising from the cooling devices of the mill stand. For this purpose specially controlled strippers and the arrangement thereof and operation have created problems especially beneath the continuously traveling rolled strip and always require maintenance.

OBJECT OF THE INVENTION

The invention has as its object to provide a device for applying lubricant to the peripheral surfaces of the working rolls of rolling mill stands which can obviate these drawbacks and avoid the difficulties which have been described.

SUMMARY OF THE INVENTION

This object is achieved in that the application of the lubricant to selected partial regions of the peripheral surface of the working rolls is effected by an adjustable shifting of the immersion roller, spray devices, scattering or spread devices, intermediate roller devices or endless belts parallel to the axis of the working rollers. The spreading device can thus according to the invention be a brush roller arranged with its axis parallel to that of an immersion roller and whose brush elements pick up the lubricant from the peripheral surface of the immersion roller and scatter the lubricant centrifugally in the direction of the intermediate roller and the working roll. When a circulating endless belt is used, the outer surface of it can be spray coated with lubricant and a metering roller pair can engage the outer and inner surfaces with adjustable pressure to meter the lubricant which is delivered by the belt. Further, the spray or conveyor devices can have shielding diaphragms extending parallel to their rotation axes and arranged downstream thereof so as to be shiftable. The applicator rollers can as the invention proposes, be jacketed with an elastic material capable of picking up a liquid or paste-like substances. The immersion rollers, spray, scattering and intermediate roll devices or endless belts can be mounted on respective carriers shiftable from positions in regions of both ends of the working roll above the respective longitudinal edges of the rolled strip opposite to one another into regions of the longitudinal center of the rolled strip and back from there. The carrier or the carriers can be configured as independent and replaceable cassettes connectable with the frame of the roll stand and the carriers and/or one or more of the rollers can be equipped with oscillating drives for oscillating them parallel to the rotation axes. Further the applicator rollers and the intermediate roll devices can optionally have different axial lengths.

With the described configurations of the device according to the invention, a highly uniform and optionally locally limited distribution of the lubricant can be achieved on the peripheral surfaces of the working roll and thus a homogeneous frictional value distribution can be achieved. The lubricant can also be precisely metered and that leads to a significant reduction in the consumption thereof. The intermediate transfer rollers between the main transfer roller and the applicator roller can improve this effect still further. The jacketing of the rollers, especially the applicator roller with an elastic material capable of picking up liquid or paste-like substances results, upon application against the peripheral surface of the working roll, to a pressing of any water film on this surface away and thus a reliable transfer of the lubricant to the peripheral surface. Any nonuniformities which may arise during roll operation at the surface of the working roll can thereby be bridged and compensated. With the aid of the partial application the peripheral width of the lubricant layer applied to the peripheral surface of the working roll and also the thicknesses thereof can be correspondingly adjusted in a metered manner in accordance with requirements.

The arrangement of the applicator roller and the transfer roller on a carrier which is transversely shiftable with respect to the rotation axis of the respective working roller improves not only the distribution of the lubricant on the peripheral surface of the working roll; it can also be used for edge lubrication of the rolled strip so as to improve the edge wear and the profile of the rolled strip.

An enrichment in lubricant at certain segments of the partial surface of the working roll which cannot and should not be avoided, is counteracted by the oscillating movement of the carrier of the applicator and/or transfer rollers according to the invention. Further advantages of the configuration of the device according to the invention reside in that no losses of lubricant arise because of an impingement or spray effect. In the rolling of roller strip in a reversing roll operation, the device need only be arranged on one side of the rolling mill stand whereas with the known spray technique described at the outset, the corresponding spray nozzles were required on both sides of the rolling mill stand. By contrast with this system, additional cooling devices can be used for the working rolls and can utilize water spray nozzles as well as antipeeling devices.

BRIEF DESCRIPTION OF THE DRAWING

The invention is described in greater detail hereafter in conjunction with the embodiments shown in the drawing.

In the drawing

SPECIFIC DESCRIPTION

Figure 1:
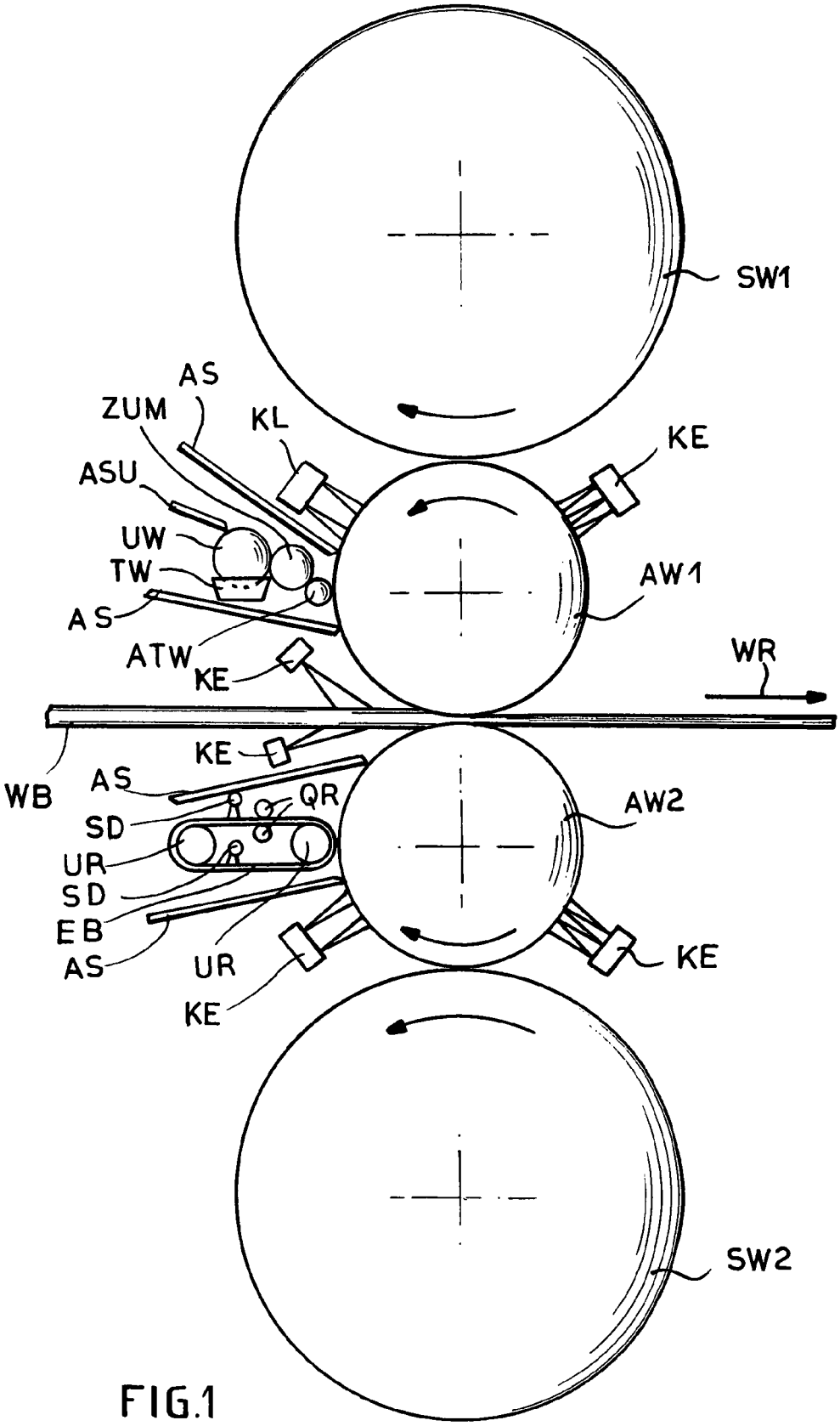
FIG. 1 is an elevational view of a radial section through the rolls of a multiroll mill stand with two different embodiments of the device in schematic illustration.

As can be seen from FIG. 1, a multiroll rolling mill stand, not shown in greater detail, has two backup rolls SW1 and SW2 which are each juxtaposed to one working roll AW1 or AW2. The two working rolls AW1 and AW2 are frictionally driven by the backup rolls SW1 and SW2 in the direction of the arrows and engage the rolled strip WB which is displaced in the rolling direction WR; their peripheral surfaces are treated by cooling devices or antipeeling devices KE.

The peripheral surfaces of the working roll AW1 facing in the direction opposite the rolling direction WR is engaged by an applicator roller ATW which, in turn, is juxtaposed with an intermediate transfer roller ZÜW, juxtaposed with a transfer roller ÜW. These rollers are in frictional engagement with one another and the transfer roller ÜW has its periphery dipping into an immersion tray TW which contains the lubricant. Instead of the immersion tray TW a spray device, here not shown, can be provided. Above and below the applicator roller ATW, with the intermediate transfer roller ZÜW, the transfer roller UW and the immersion tray TW the peripheral surface of the working roll AW1 is engaged by strippers AS. A further stripper ASÜ lies against the periphery of the main transfer roller ÜW and is shiftable parallel to the rotation axis of the working roll AW1 in a manner not shown.

The peripheral surface of the other working roll AW2, below the rolled strip WB, is engaged by an endless belt EB which is comprised of an elastic material capable of taking up the lubricant and driven in a manner not shown but passing over the rerouting roller pair UR. The upwardly and downwardly turned surfaces of this endless belt EB are treated with lubricant by spray jet nozzles SD, and the upper pass of the belt passes through a squeezing gap between the squeezing roller pair QR. Above and below this arrangement and also in engagement with the peripheral surfaces of the working roll AW2 are strippers AS.

Figure 2:
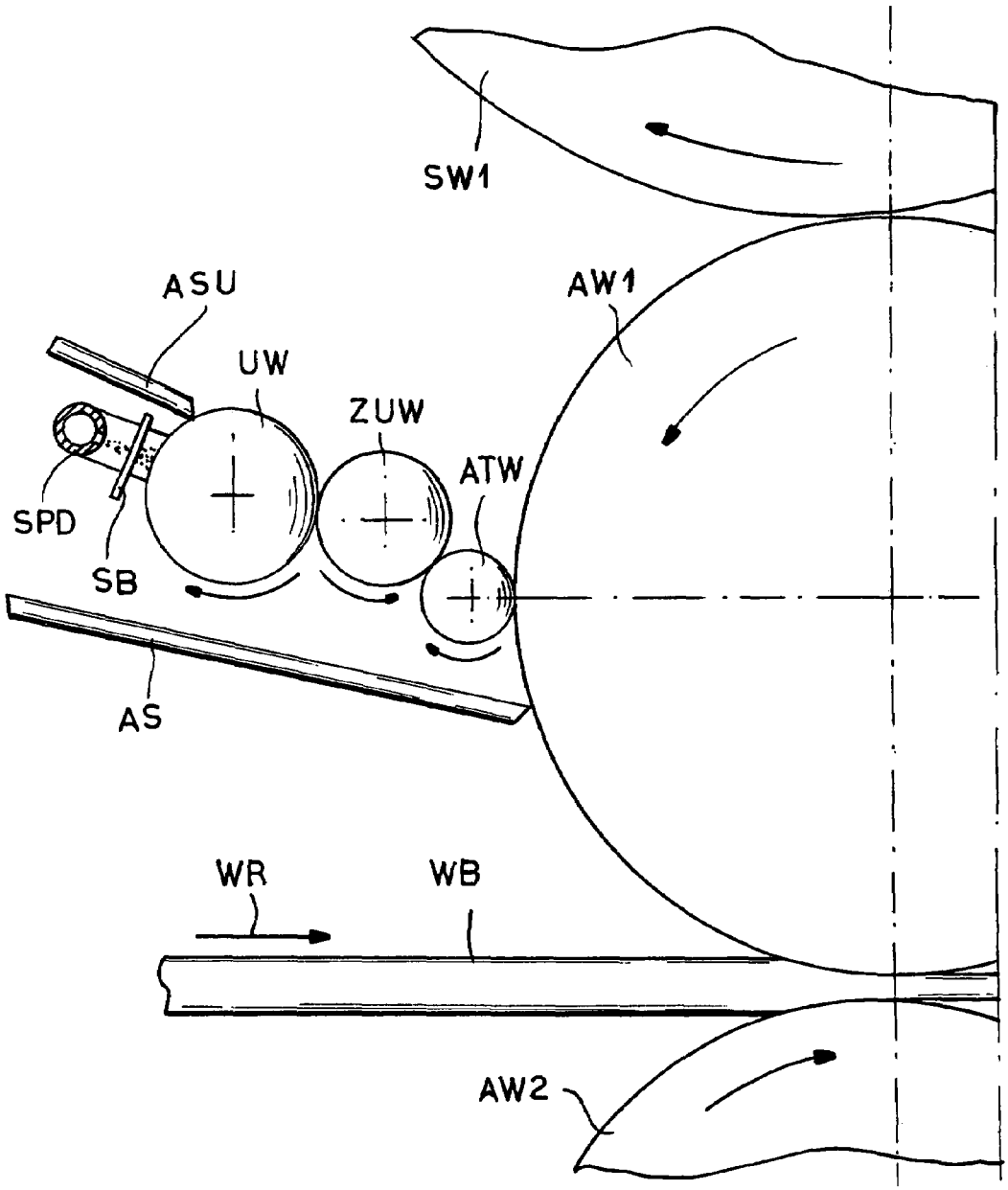
FIG. 2 is a partial elevation of FIG. 1 with another embodiment of the device in a larger scale.

The arrangement of the applicator roller ATW, the intermediate transfer roller ZÜW and the main transfer roller ÜW according to FIG. 2 corresponds to that shown in FIG. 1 and the described drawing with the feature that the main transfer roller UW here has a spray nozzle SPD juxtaposed therewith, in whose spray jet, a slidable diaphragm SB parallel to the rotation axis of the main transfer roller ÜW is disposed and with the aid of which the impingement field for the lubricant on the peripheral surface of the main transfer roller ÜW turned toward the spray nozzle SPD is determined and optionally can be altered. With the stripper ASU engaging the peripheral surface of the main transfer roller UW, this result can also be achieved and, in addition, the coating thickness of the lubricant can be regulated.

Figure 3:
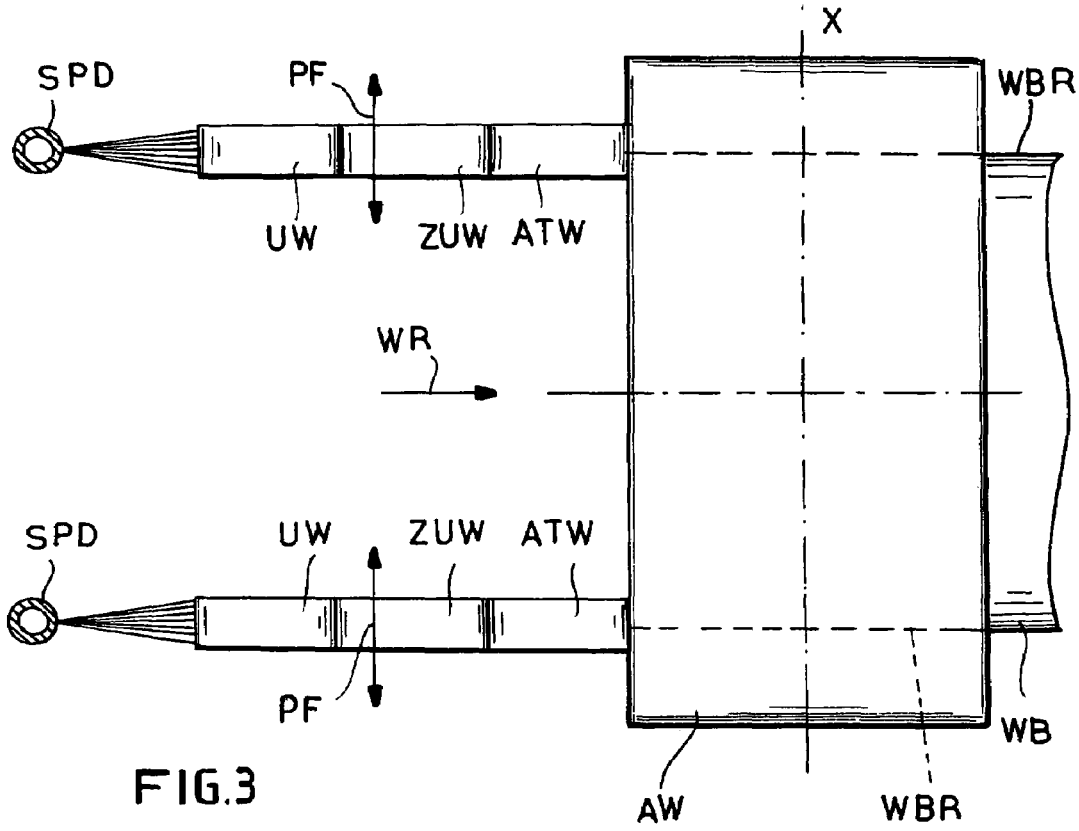
FIG. 3 is a plan view of a further embodiment of the device in a schematic illustration.

In the arrangement according to FIG. 3, applicator rollers ATW, intermediate transfer rollers ZÜW, main transfer rollers ÜW and spray nozzles SPD together are respectively arranged on a carrier not shown in detail and which is shiftable in the direction of the double arrow PF parallel to the rotation axis x-x of the working roll AW. The carrier with the rollers and the respective spray nozzle can be shiftable back and forth from the illustrated positions above the respective edges WBR of the roller strip WB parallel to the rotation axis x-x of the working roll AW toward and away from one another and enable thereby, especially the regions of the edges but also other regions of the rolled strip to be provided with lubricant.

Figure 4:
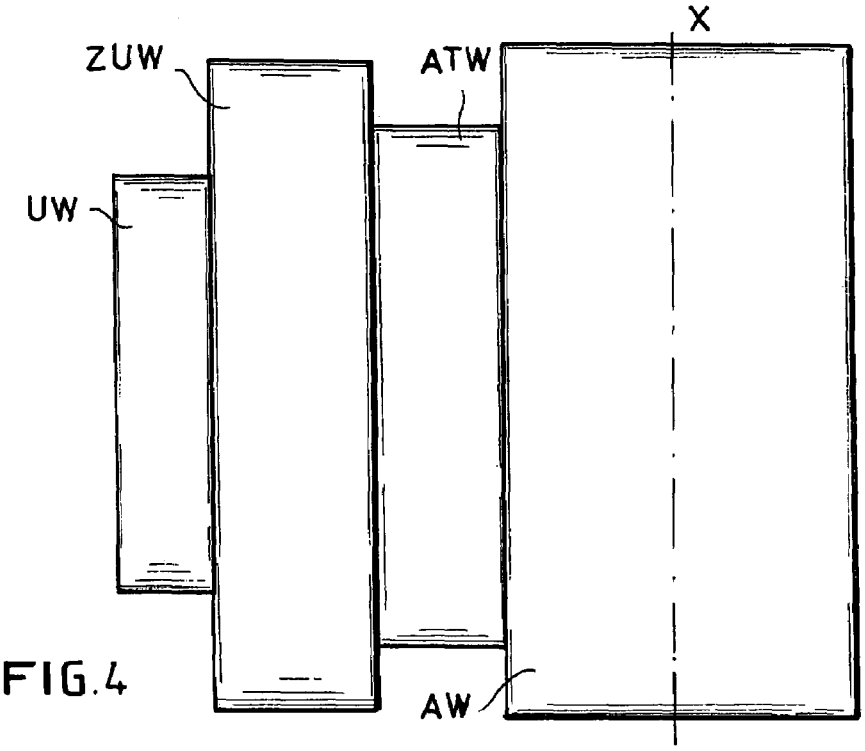
FIG. 4 is a plan view of a further additional embodiment of the device according to the illustration in FIG. 3.

When on operational grounds in regions of the roll the applied lubricant is enriched, the nonuniform distribution of lubricant thus resulting can lead to strip travel problems. To achieve a uniform layer thickness or film thickness on the roll, the rolls can be driven so that they oscillate in the direction of their rotation axes. This can be applied to one or several rollers. Lengths of the rollers ÜW, ZÜW and ATW which are stepped from one to the other (FIG. 4) and are determined by one another ensure the uniform distribution of the applied lubricant.

Figure 5:
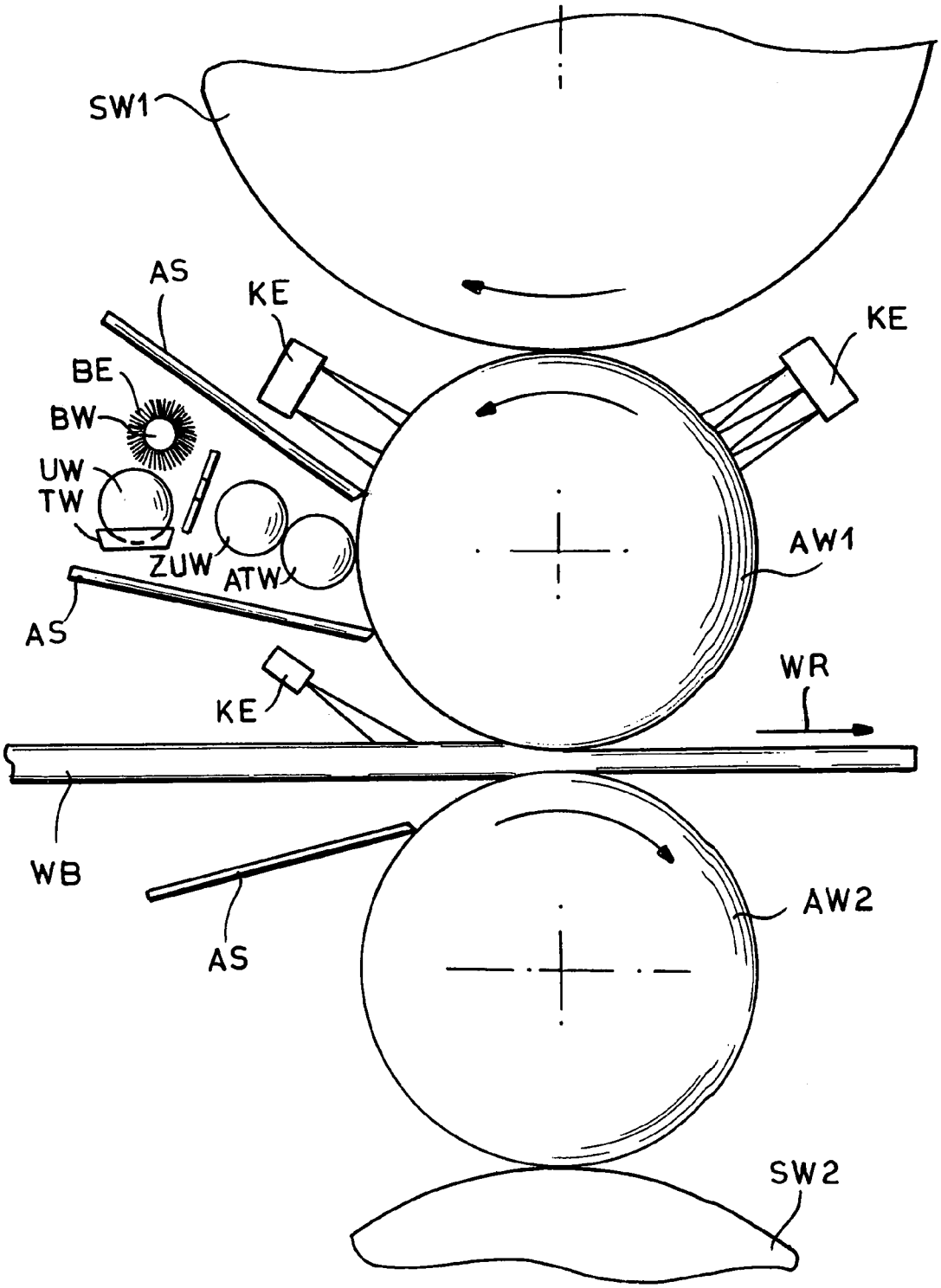
FIG. 5 is a further embodiment of the device in a schematic illustration.

In the arrangement of the main transfer roller ÜW of FIG. 5, above this roller and its immersion tray TW, a brush roller BW can be rotatably driven and can have its elastic brush elements BE arranged to centrifugally disperse the lubricant from the surface of the transfer roller ÜW to the surface of the intermediate transfer roller ZÜW. From there the lubricant is transferred as in the configuration of FIG. 1 to the applicator roller ATW and from that to the surface of the working roll AW against which it presses. Between the brush roller BW and the intermediate transfer roller ZÜW, a shiftable slide diaphragm SB is arranged as in FIG. 2, with the aid of which lubricant is applied to the region to be coated of the surface of the intermediate transfer roller ZÜW and from the latter to the regions to be coated of the surface of the applicator roller ATW in a width dependent manner, for example also for the edge lubrication of the rolled strip WB.

The invention claimed is:

1. In combination with a mill stand having upper and lower working rolls rotatable about respective parallel axes and normally pinching a workpiece strip passing horizontally between surfaces of the working rolls and respective upper and lower backing rolls bearing downward and upward on the upper and lower working rolls, a lubricating apparatus comprising:

a supply of fluent lubricant spaced from the rolls;

an immersion roller spaced from the working rolls, rotatable about an axis generally parallel to and offset from the working-roll axes, and partially immersed in the lubricant in the supply;

an applicator member having a moving surface bearing on one of the working-roll surfaces and spaced from the immersion roller;

a brush rotatable about an axis generally parallel to the immersion-roller and working-roll axes and having bristles out of direct contact with the applicator member and engaging the immersion roller; and means for rotating the immersion roller and applicator brush for lifting the lubricant from the supply with the immersion roller and transferring it to the bristles of the brush and for throwing the lubricant transferred to the bristles from the bristles onto the applicator member, whereby the lubricant is transferred from the applicator member to the working rolls by direct contact.

2. The roll-lubricating apparatus defined in claim 1 wherein the brush is of an axial length substantially shorter than the working rolls, the apparatus further comprising means for shifting the brush parallel to the immersion-roll and working-roll axes back and forth along the working rolls and between ends thereof and thereby applying the lubricant only locally to the one working roll.

3. The roll-lubricating apparatus defined in claim 2 wherein there are two such brushes, supplies, immersion rollers, and applicator members for the one working roll with each supply, brush, immersion roller, and applicator member forming a respective applicator device, the apparatus further comprising means for oppositely axially the applicator devices from widely spaced outer positions at longitudinal edges of the workpiece strip to center positions generally at a center of the workpiece strip.

4. The lubricating apparatus defined in claim 1 wherein the applicator member is a roller.

5. The lubricating apparatus defined in claim 1 wherein the applicator member is a belt.

6. In combination with a mill stand having upper and lower working rolls rotatable about respective parallel axes and normally pinching a workpiece strip passing horizontally between surfaces of the working rolls and respective upper and lower backing rolls bearing downward and upward on the upper and lower working rolls, a lubricating apparatus comprising:

a supply of fluent lubricant spaced from the rolls;

an immersion roller spaced from the working rolls, substantially axially shorter than the working rolls, rotatable about an axis generally parallel to and offset from the working-roll axes, and partially immersed in the lubricant in the supply;

an applicator member substantially axially shorter than the working rolls and having a moving surface bearing on one of the working-roll surfaces and spaced from the immersion roller;

a transfer member substantially axially shorter than the working rolls, rotatable about an axis generally parallel to the immersion-roller and working-roll axes, and engaging the immersion roller;

means for rotating the immersion roller and transfer member for lifting the lubricant from the supply with the immersion roller and transferring it to the transfer member and for transferring the lubricant transferred to the transfer member to the applicator member, whereby the lubricant is transferred from the applicator member to the working rolls by direct contact; and means for axially shifting the rollers and transfer member along the working rolls and thereby applying the lubricant only locally to the one working roll.

7. The lubricating apparatus defined in claim 6 wherein the transfer member is a brush having bristles engaging the immersion roller.

8. The lubricating apparatus defined in claim 6 wherein the transfer member is a roller.

9. The lubricating apparatus defined in claim 6 wherein the applicator member is a roller.

10. The lubricating apparatus defined in claim 6 wherein the applicator member is a belt.

11. In combination with a mill stand having upper and lower working rolls rotatable about respective parallel axes and normally pinching a workpiece strip passing horizontally between surfaces of the working rolls and respective upper and lower backing rolls bearing downward and upward on the upper and lower working rolls, a lubricating apparatus comprising:

a supply of fluent lubricant spaced from the rolls;

an applicator member of an axial length substantially shorter than the working rolls and having a moving surface bearing on one of the working-roll surfaces and spaced from the immersion roller;

means for applying the lubricant on the applicator member so that the lubricant is transferred by the applicator member to the one working roll; and means for axially shifting the applicator member and means for applying and thereby applying the lubricant only locally to the one working roll.

12. The lubricating apparatus defined in claim 11 wherein the means for applying includes a rotatable brush rotated to throw the lubricant on the applicator member.

13. The lubricating apparatus defined in claim 12 wherein the means for applying further includes a short immersion roller axially coupled to the applicator member, immersed in the supply, and engaging bristles of the brush.

14. The lubricating apparatus defined in claim 11 wherein the means for applying is a sprayer.

* * * * *